US009661688B2

(12) United States Patent
Mangold

(10) Patent No.: US 9,661,688 B2
(45) Date of Patent: May 23, 2017

(54) COOLING AND RETAINING BODY FOR HEATING ELEMENTS, HEATING APPLIANCE AND METHOD FOR PRODUCING A COOLING AND RETAINING BODY

(71) Applicant: STEGO-HOLDING GMBH, Schwaebisch Hall (DE)

(72) Inventor: Elmar Mangold, Unterschneidheim (DE)

(73) Assignee: STEGO-HOLDING GMBH, Schwaebisch Hall (DE)

( * ) Notice: Subject to any disclaimer, the term of this patent is extended or adjusted under 35 U.S.C. 154(b) by 155 days.

(21) Appl. No.: 14/354,003

(22) PCT Filed: Oct. 22, 2012

(86) PCT No.: PCT/EP2012/070867

§ 371 (c)(1),
(2) Date: Apr. 24, 2014

(87) PCT Pub. No.: WO2013/060645

PCT Pub. Date: May 2, 2013

(65) Prior Publication Data

US 2014/0290907 A1 Oct. 2, 2014

(30) Foreign Application Priority Data

Oct. 24, 2011 (DE) ..... 10 2011 054 750

(51) Int. Cl.
*H05B 3/06* (2006.01)
*H05B 1/02* (2006.01)
(Continued)

(52) U.S. Cl.
CPC ..... *H05B 3/06* (2013.01); *F24H 1/101* (2013.01); *F24H 3/0411* (2013.01);
(Continued)

(58) Field of Classification Search
USPC ..... 219/531, 536, 537, 538–540, 520, 532, 219/533, 534, 535, 542, 546, 547, 548,
(Continued)

(56) References Cited

U.S. PATENT DOCUMENTS 3,108,174 A 10/1963 Hynes
3,146,519 A * 9/1964 Redwine ..... H01R 43/058 174/84 C
3,662,149 A * 5/1972 Lipinski ..... E05B 17/0016 219/201
3,996,447 A 12/1976 Bouffard et al.
4,092,396 A * 5/1978 McCartney ..... G02B 6/403 264/1.25
4,232,214 A 11/1980 Shioi et al.
4,331,861 A 5/1982 Meixner
(Continued)

FOREIGN PATENT DOCUMENTS

CN 1347264 A 5/2002
CN 101868675 A 10/2010
(Continued)

OTHER PUBLICATIONS

Chinese Office Action to Chinese Patent Application No. 201280051845.2 dated Mar. 11, 2015 (no English translation provided) (5 pages).
(Continued)

*Primary Examiner* — David Angwin
*Assistant Examiner* — Gyounghyun Bae
(74) *Attorney, Agent, or Firm* — Brooks Kushman P.C.

(57) ABSTRACT

A cooling and retaining body for holding heating elements, in particular PTC heating elements, having a heating-element holder, in which the heating elements are mounted. The heating element holder has a plurality of circumferentially distributed accommodating regions, in each of which at least one heating element is arranged, wherein the accommodating regions are formed between an outer part and an inner part, which is arranged in the outer part, and at least the outer part has a polygonal profile with a number of corners connected by sides, wherein the accommodating regions are arranged in the corners of the polygonal profile, and the sides of the polygonal profile are deformed elastically in order to generate a clamping force which acts on the respective heating elements.

15 Claims, 8 Drawing Sheets

Figure 1:
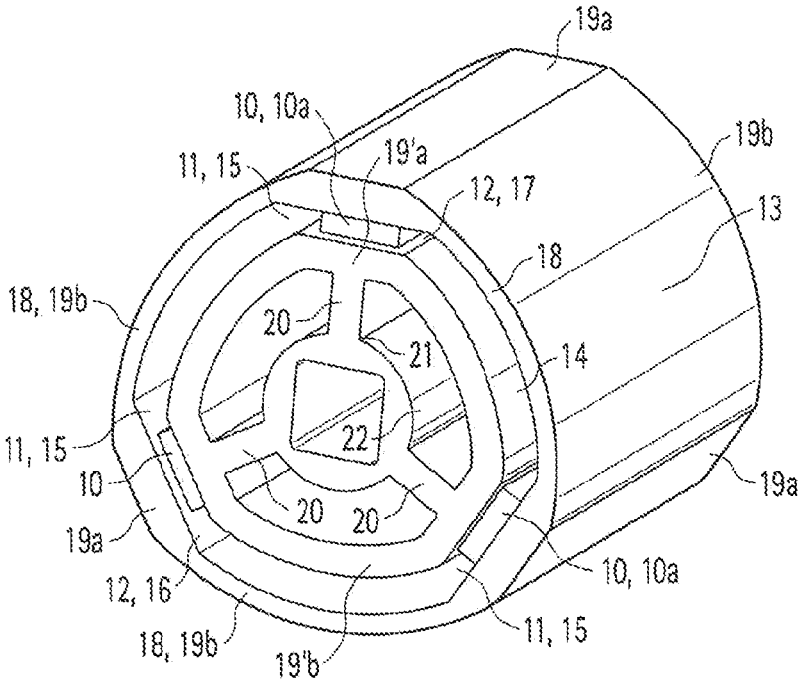

(51) Int. Cl.

| | |
|---|---|
| ***H05B 3/50*** | (2006.01) |
| ***H01C 7/13*** | (2006.01) |
| ***F24H 3/04*** | (2006.01) |
| ***F24H 9/18*** | (2006.01) |
| ***F24H 1/10*** | (2006.01) |

(52) U.S. Cl.
CPC ..... *F24H 3/0435* (2013.01); *F24H 9/1872* (2013.01); *H05B 3/50* (2013.01); *F24H 2250/04* (2013.01); *H05B 2203/02* (2013.01); *H05B 2203/023* (2013.01); *Y10T 29/49865* (2015.01)

(58) Field of Classification Search
USPC ..... 219/504–505; 264/272.1, 272.15, 264/257–279; 392/422, 501; 174/520, 174/521; 132/229, 232; 137/341
See application file for complete search history.

(56) References Cited

U.S. PATENT DOCUMENTS 4,334,141 A 6/1982 Roller et al.
4,352,008 A * 9/1982 Hofer ..... H05B 3/50 165/183
4,425,692 A * 1/1984 Minegishi ..... F23Q 7/001 123/145 A
4,431,983 A 2/1984 Rodriguez
4,578,235 A 3/1986 Schmidgall et al.
4,635,026 A 1/1987 Takeuchi
4,654,478 A * 3/1987 Ishihara ..... H01B 17/40 174/176
4,673,801 A * 6/1987 Leary ..... H05B 3/56 219/211
4,814,584 A * 3/1989 Bohlender ..... H05B 3/14 219/505
4,822,980 A * 4/1989 Carbone ..... H05B 3/82 219/205
4,850,097 A 7/1989 Graf et al.
4,855,570 A * 8/1989 Wang ..... F24H 3/0405 219/205
4,855,571 A * 8/1989 Ting ..... H05B 3/141 219/532
4,870,249 A * 9/1989 Kayanuma ..... F02M 31/135 123/549
4,874,924 A 10/1989 Yamamoto et al.
4,931,626 A * 6/1990 Shikama ..... H05B 3/14 165/96
4,942,289 A * 7/1990 Roller ..... H05B 3/14 219/504
4,954,692 A * 9/1990 Shikama ..... H05B 3/14 219/505
5,125,070 A * 6/1992 Chung-Tai ..... H05B 3/30 219/505
5,153,555 A 10/1992 Enomoto et al.
5,166,497 A * 11/1992 Meyer ..... F24D 13/024 219/213
5,192,853 A * 3/1993 Yeh ..... H05B 3/141 219/505
5,198,640 A 3/1993 Yang
5,201,774 A 4/1993 Greene
5,204,044 A * 4/1993 Yoneshige ..... B29C 45/14467 264/272.15
5,300,760 A * 4/1994 Batliwalla ..... H05B 3/56 174/107
5,471,029 A * 11/1995 Simmons ..... B23K 11/3018 219/120
5,760,676 A 6/1998 Yamada
5,845,384 A * 12/1998 Retzbach ..... B23P 11/022 29/252
5,922,231 A * 7/1999 Karst ..... H05B 3/14 219/504
6,054,692 A * 4/2000 Hitomi ..... E01C 11/265 219/469
6,079,716 A * 6/2000 Harman, Jr. ..... B23Q 3/12 279/143
6,090,231 A * 7/2000 Saito ..... H02G 1/14 156/51
6,169,472 B1 1/2001 Kahr
6,180,930 B1 * 1/2001 Wu ..... F24H 3/0429 219/530
6,318,864 B1 * 11/2001 Fukaya ..... G02B 21/0012 359/368
6,455,822 B1 9/2002 Chang
6,847,017 B2 * 1/2005 Starck ..... H05B 3/14 219/530
7,064,301 B2 * 6/2006 Han ..... F24H 3/0405 219/202
7,217,072 B1 * 5/2007 Haimer ..... B23B 31/1179 279/9.1
7,332,693 B2 * 2/2008 Hamburger ..... H01C 1/01 219/504
7,335,855 B2 * 2/2008 von der Luhe ..... H01C 1/014 219/201
7,860,381 B2 12/2010 Wallhaeusser et al.
7,862,271 B2 * 1/2011 Wang ..... B21J 5/066 228/112.1
8,478,117 B2 7/2013 Eisenhauer et al.
8,541,722 B2 * 9/2013 Lauth ..... H05B 3/42 219/544
8,975,561 B2 * 3/2015 Luppold ..... B60H 1/2225 219/201
9,161,391 B2 * 10/2015 Niederer ..... H05B 3/24
2001/0018828 A1 9/2001 Kadotani
2002/0040899 A1 4/2002 Chang
2003/0095795 A1 * 5/2003 Birdsell ..... F24H 3/0405 392/365
2005/0034306 A1 2/2005 Patberg et al.
2009/0277523 A1 * 11/2009 Miyazaki ..... B21D 39/06 138/106
2010/0282337 A1 11/2010 Christodoulou et al.
2012/0140788 A1 * 6/2012 Carkin ..... F27B 3/08 373/109
2013/0000108 A1 1/2013 Bohlender et al.

FOREIGN PATENT DOCUMENTS

| | | | |
|---|---|---|---|
| CN | 102529640 A | | 7/2012 |
| DE | 2804749 | | 8/1979 |
| DE | 2804818 | | 8/1979 |
| DE | 7934523 | | 3/1980 |
| DE | 3816819 | | 11/1989 |
| DE | 4010620 | | 10/1991 |
| DE | 19604218 | * | 8/1997 |
| DE | 20120821 | | 5/2002 |
| DE | 202005020765 | | 7/2006 |
| DE | 102006018151 | | 10/2007 |
| EP | 1847785 | | 10/2007 |
| EP | 1847786 | | 10/2007 |
| EP | 2 053 902 A1 | | 4/2009 |
| GB | 2 143 708 A | | 2/1985 |
| GB | 2143708 | | 2/1985 |
| JP | S5561688 U | | 4/1980 |
| JP | 10-220909 A | | 8/1998 |
| RU | 24482 U1 | | 10/2002 |
| RU | 25582 U1 | | 10/2002 |

OTHER PUBLICATIONS

Chinese Office Action to Chinese Patent Application No. 201280052012.8 dated Mar. 16, 2015 (no English translation provided) (8 pages).
International Search Report for PCT/EP2012/070867, English translation attached to original, Both completed by the European Patent Office on Apr. 4, 2013, All together 7 Pages.
Taiwanese Office Action dated Jul. 22, 2016, Application No. 101139059, (English translation provided).

* cited by examiner

COOLING AND RETAINING BODY FOR HEATING ELEMENTS, HEATING APPLIANCE AND METHOD FOR PRODUCING A COOLING AND RETAINING BODY

CROSS-REFERENCE TO RELATED APPLICATION

This application is the U.S. national phase of PCT Application No. PCT/EP2012/070867 filed one Oct. 22, 2012, which claims priority to German Patent Application No. 10 2011 054 750.9 filed on Oct. 24, 2011, the disclosures of which are incorporated in their entirety by reference herein.

The invention relates to a cooling and holding body for heating elements, in particular PTC heating elements, a heater having such a cooling and holding body and a method for the manufacture of such a cooling and holding body. A cooling and holding body for heating elements having the features of the preamble of claim 1 is disclosed in DE 10 2006 018 151 A1.

In control cabinets, for example, temperature changes cause the formation of condensate which, together with dust and aggressive gases, can cause corrosion. The risk of breakdowns due to leakage currents or flashovers increases as a result. Heaters or fan heaters, in particular PTC semiconductor heaters, which are subject to high requirements in terms of reliability and longevity, are therefore used to ensure consistently optimum climatic conditions for perfect functioning of the components located in the control cabinet.

Such heaters are usually fitted with electric heating elements. The holding device of these heating elements should enable good heat transfer on one hand and consistently secure fixing on the other. The frequent and, depending on the operating conditions, major temperature changes can lead to material fatigue due to aging and therefore to a decrease in the holding force with which the heating elements are fixed. The heat transfer deteriorates as a result. If the holding function is lost completely, the result may even be a total failure of the device.

DE 196 04 218 A1 describes an example of a known heater with a PTC element in which the PTC element is fastened in a rectangular recess arranged centrally. A double wedge arrangement which can be moved by means of an adjusting screw in order to alter the width of the double wedge arrangement is provided in the recess for mounting. The PTC element can therefore be jammed in the recess. The double wedge arrangement is complex and does not eliminate the problem of the decrease in clamping force due to material fatigue. The double wedge arrangement would have to be adjusted by manipulating the screw in order to prevent this.

An improvement of this known device is disclosed in the generic DE 2006 018 151 A1 which refers back to the applicant. In this case, the heating element is disposed in the centrally arranged recess of a heat exchanger, wherein the inner contact surfaces of the recess lie flat against the heating element. The holding force is achieved in that, after installation of the heating element, side walls of the heat exchanger are bent inwards which reduces the gap between the contact surfaces of the recess. The heating element disposed between the contact surfaces is firmly clamped flat as a result. This fastening is a stable holding device which delivers a constantly high holding force and therefore constantly good heat transfer from the heating element to the heat exchanger without readjustment. Bending in of the side walls, however, leads to a plastic deformation of the wall material which is not optimal for the holding conditions because of the frequent temperature changes.

Thus the object of the invention is to improve a cooling and holding body of the type referred to at the outset to the effect that a secure holding device for the heating element or heating elements in the cooling and holding body is achieved despite frequent temperature changes. The object of the invention is also to specify a heater having such a cooling and holding body and a method for the manufacture of such a cooling and holding body.

According to the invention, this object is achieved by the holding and cooling body according to claim 1, the heater according to claim 11 and the method according to claim 12.

The invention is based on the idea of specifying a cooling and holding body for heating elements, in particular electric heating elements, in particular PTC heating elements, which has a heating element holder in which the heating elements are clamped. The heating element holder has a plurality of holding regions distributed in the peripheral direction in each of which at least one heating element is arranged. The holding regions are formed between an outer section and an inner section arranged within the outer section. At least the outer part has a polygonal profile having a plurality of corners which are joined by sides. The holding regions are arranged in the corners of the polygonal profile. The sides of the polygon are elastically deformed to generate a clamping force, wherein the clamping force acts on the relevant heating elements.

Unlike the known clamping of the heating elements achieved by means of plastic deformation, according to the invention the sides of the polygonal profile are elastically deformed. This means that the deformation takes place within the range of Hook's straight line and is proportional to the stress generated in the polygonal profile. The clamping force with which the heating elements are clamped in the holding regions of the heating element holder is optimized as a result of the deformation below the elastic limit. In contrast to plastic deformation, settling which occurs due to material aging is prevented. The clamping force with which the heating elements are fixed remains constant or at least substantially constant despite the temperature changes. An essentially constant heat transfer from the heating elements to the material of the holding and cooling body is achieved due to the constant clamping force. The elastic deformation causes the force with which the heating elements are pressed on to act as a spring force. Readjustment of the contact force or clamping force is not necessary.

The configuration of at least the outer section as a polygonal profile has the advantage that the heating performance is increased and it is possible to clamp the heating elements without additional clamping elements. Elimination of the clamping elements enables a compact design of the holding and cooling body. Unlike the prior art, a single centrally arranged holding region is not provided but rather a plurality of holding regions distributed in the peripheral direction of the outer section. As a result, the thermal output in the holding and cooling body is better distributed and facilitates efficient heat dissipation. Assembly of the heating elements is simplified by the combination of the inner section with the polygonal outer section. Configuration of the outer section as a polygonal profile has the further advantage that this can be manufactured, for example, by means of extrusion.

In a preferred embodiment, the corners of the polygonal profile form clamping surfaces which are adapted to the shape of the heating elements, in particular are flattened, as a result of which an especially good heat transfer is achieved. The flattened clamping surfaces are particularly well suited to the use of flat heating elements in the form of PTC resistors which are directly joined to the outer section and the inner section which results in further improvement of the heat transfer. Other clamping holders, in particular profiled clamping holders, are possible.

The wall thickness of the outer section may be greater in the region of the polygonal profile's corners than in the region of the polygonal profile's sides. As a result, even heat dissipation is achieved in the region of the corners or clamping surfaces.

The sides of the polygonal profile are preferably configured to be concave, convex or straight. This results in various possibilities for assembling the heating elements, in particular various possibilities for introducing the assembly force.

The thickness of the sides of the polygonal profile may vary in the peripheral direction, in particular it may decrease towards the corners. As a result, the introduction of force during assembly is improved, said introduction taking place in the central region of the sides, in particular in the apex of each side. The force is introduced linearly in the direction of the longitudinal axis. Due to maximization of the wall thickness or the thickness of the side in the central region or in the apex, the force introduced there is safely transmitted into the marginal regions of the side in order to achieve maximum elastic deformation.

The inner section may have a number of holding surfaces for the heating elements corresponding to the number of corners of the polygonal profile. In combination with the clamping surfaces, the result is a support for the heating elements which is flat on both sides thus ensuring a secure mechanical holding device and a good thermal connection between heating element and body.

The inner section preferably has a polygonal profile having a plurality of corners which are joined by sides, wherein the holding surfaces correspond to the corners of the polygonal profile.

In a preferred embodiment, the holding surfaces are only supported radially inwards by the sides of the polygonal profile. The shape of the inner section and therefore the position of the holding surfaces is variable due to the elasticity of the sides. The inner section is movable per se. The holding surfaces can be moved radially inwards by means of an assembly force acting in an appropriate direction on the sides of the polygonal profile in order to enlarge the assembly gap between the inner section and the outer section. In the case of sides curved convexly outwards, the assembly or spreading force acts from the inside outwards. The sides are pressed outwards and pull the holding surfaces radially inwards. In the case of sides curved concavely outwards, the assembly or spreading force acts from the outside inwards. The sides are pressed inwards and pull the holding surfaces radially inwards.

Alternatively, the holding surfaces are supported by bars, wherein the bars each extend inwards in the radial direction. Compared to the embodiment mentioned above, a relatively rigid shape of the inner section is achieved as a result. The position of the holding surfaces is relatively stable during assembly. Moreover, the bars enlarge the surfaces which are effective for heat dissipation and improve the inner section's stability.

In a particularly preferred embodiment, the heating elements include PTC resistors which are arranged in the holding regions and are joined directly to the outer section and the inner section, in particular are joined electrically and thermally. Direct connection of the PTC resistors to the outer and inner section improves the heat transfer between the heating elements and the holding and cooling body. Alternatively, it is possible to arrange the heating elements in the form of PTC cartridges known per se in the holding regions. An embodiment with insulating foil and separate electrodes is conceivable for a protection class 2 application.

In a further preferred embodiment, at least three heating elements are distributed around the periphery of the outer section, in particular are distributed symmetrically. This number of heating elements leads to a statically defined system which beyond this is self-centering. A larger number of heating elements is possible.

A plurality of layers of heating elements arranged in the radial direction can be provided to increase the heating performance, wherein at least one intermediate section is arranged between the outer section and the inner section. The holding regions are configured between the inner section and the intermediate section on one hand and between the intermediate section and the outer section on the other hand. The holding regions configured between the inner and intermediate section form a first inner layer of heating elements. The holding regions configured between the intermediate section and the outer section accommodate a second layer of heating elements arranged radially further outwards. The number of heating layers can be increased correspondingly by the arrangement of further intermediate sections. 3, 4 or more heating layers are conceivable, wherein the intermediate sections of the individual heating layers are each constructed accordingly.

Within the scope of the invention, a heater which has a cooling and holding body according to the invention is additionally disclosed and claimed. One axial end of the cooling and holding body is joined to a fan in such a manner that air can flow through the cooling and holding body in the longitudinal direction, said air cooling the heating elements and transporting the heat to the desired location, for example in a control cabinet. Due to the arrangement of inner and outer section in combination with the fan, it is possible to ensure that the inner section is hotter in operation in comparison to the outer section and that the clamping force during operation additionally increases due to the thermal expansion of the inner section.

The cooling and holding body may be arranged in an insulated housing. This embodiment is particularly suitable in the case where the PTC resistors are directly joined to the outer section and/or the inner section.

Within the scope of the invention, a method is further disclosed for the manufacture of a cooling and holding body according to the invention in which the diameter of the outer section is enlarged for mating. To enlarge the diameter, the outer section is heated and/or is impinged with an assembly force acting radially inwards or outwards respectively on the sides of the polygonal profile. The polygon sides are elastically deformed due to the assembly force. The individual components, i.e. the inner section, the heating elements and the outer section enlarged in cross-section are then assembled in such a manner that the heating elements are located in the relevant holding regions. Thereafter, the outer section is cooled and/or relieved of pressure such that it shrink-fits onto the heating elements and holds all the heating elements with the same contact force. Within the scope of the method according to the invention, assembly of the outer section may be achieved either exclusively thermally by means of shrink-fitting or exclusively mechanically by means of elastic deformation of the clamping elements or by means of a combination of thermal and mechanical enlargement of the diameter.

Figure 2:
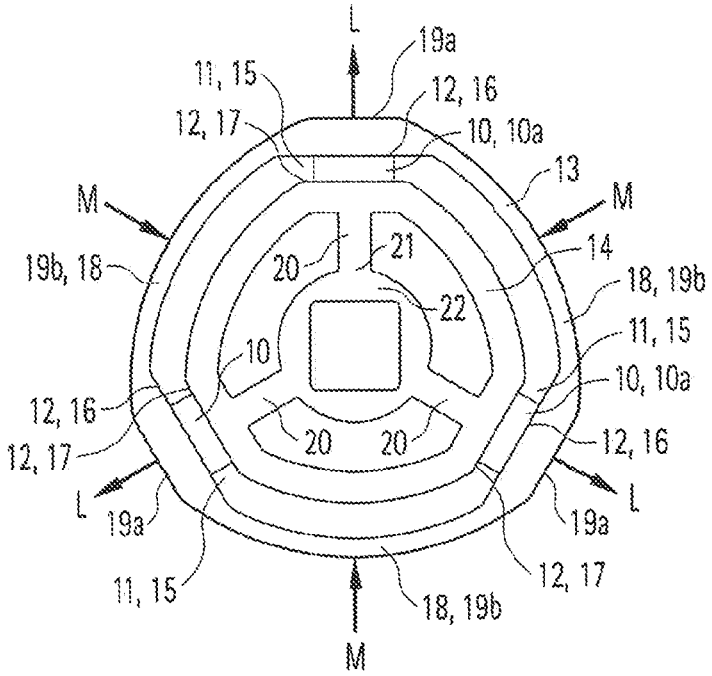
Figure 3:
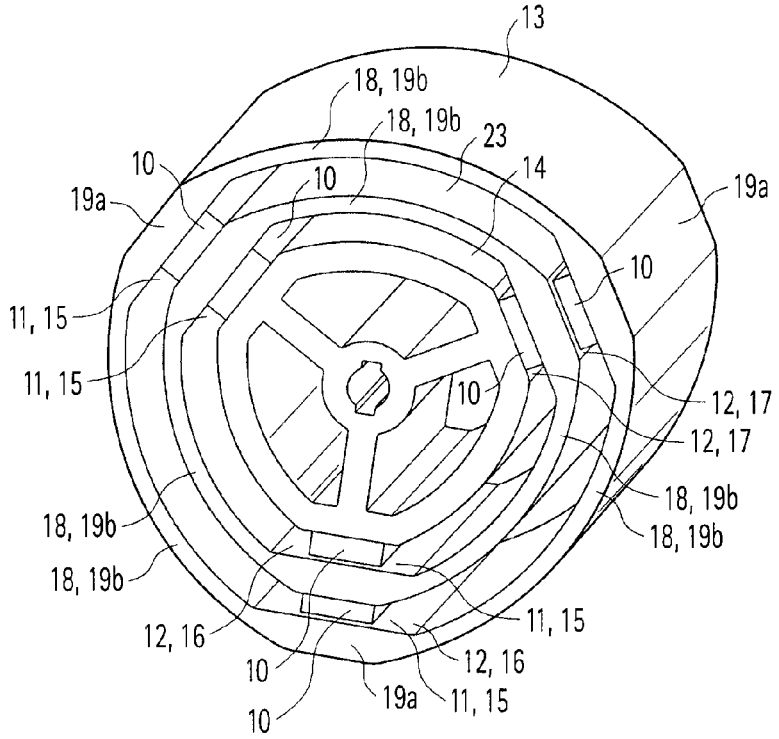
Figure 4:
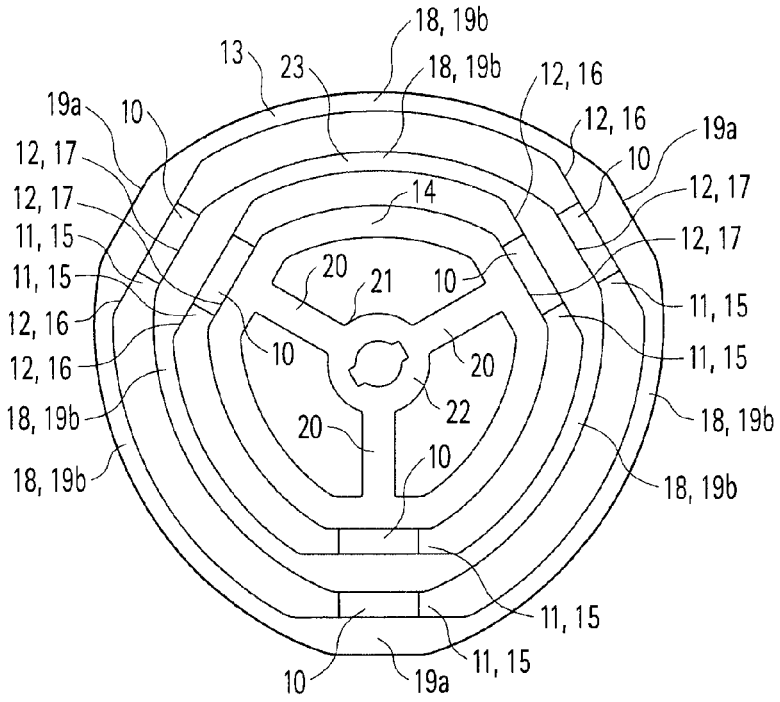
Figure 5:
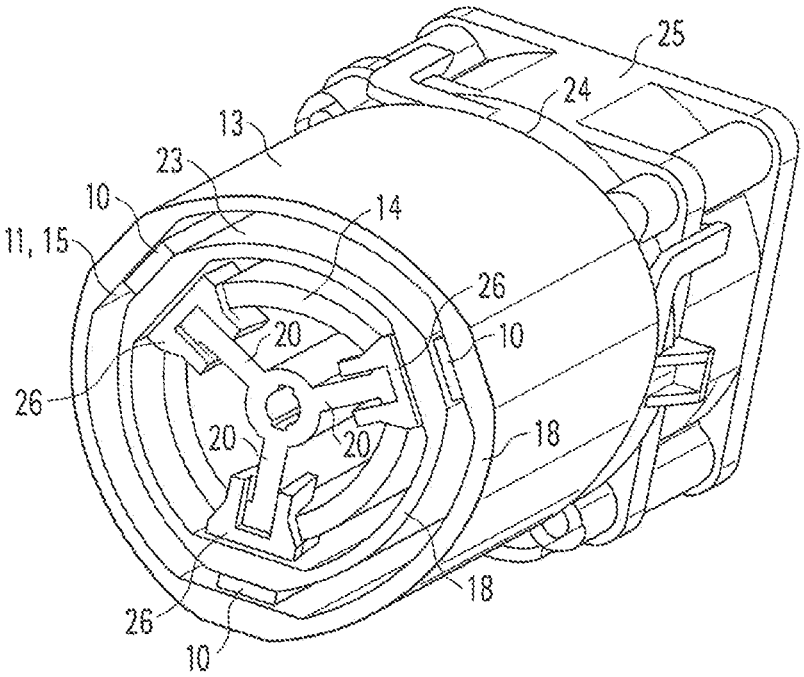
Figure 6:
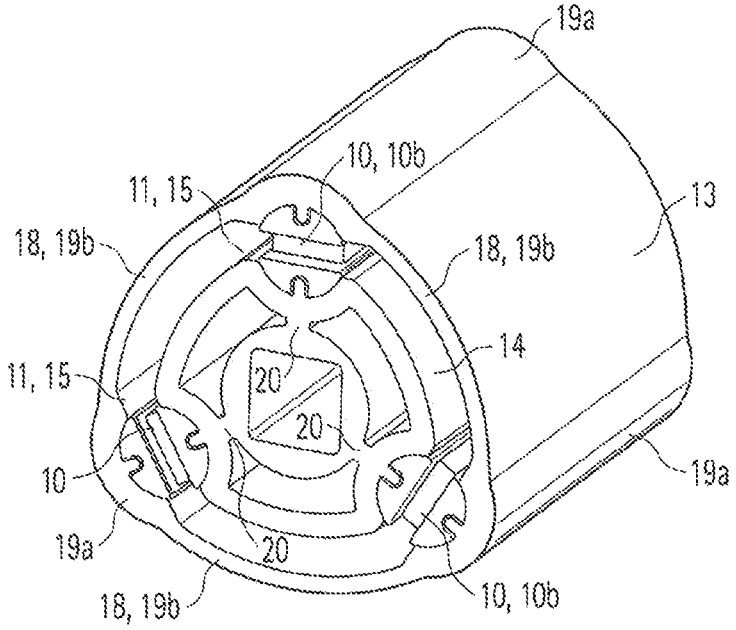
Figure 7:
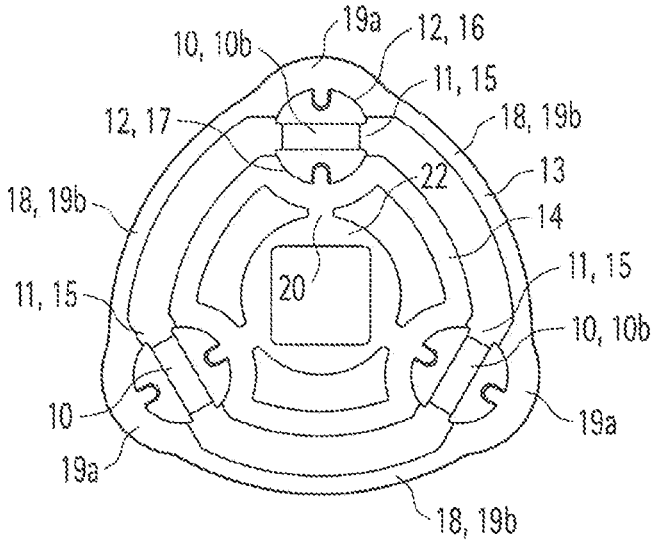
Figure 8:
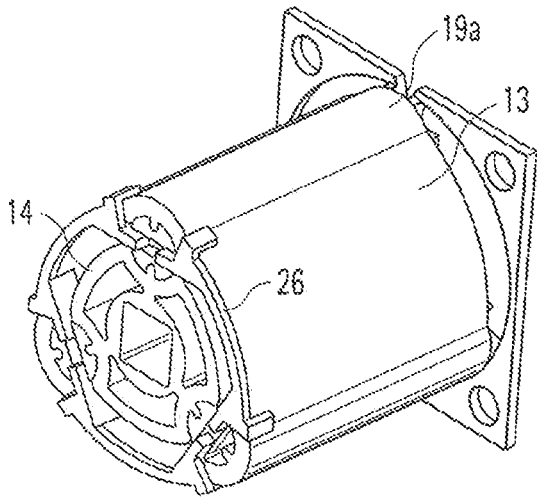
Figure 9:
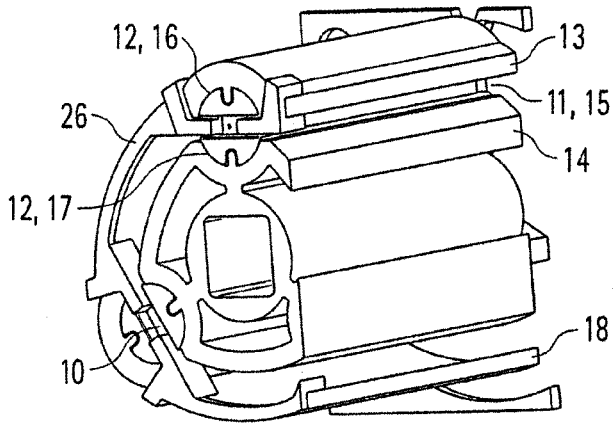
Figure 10:
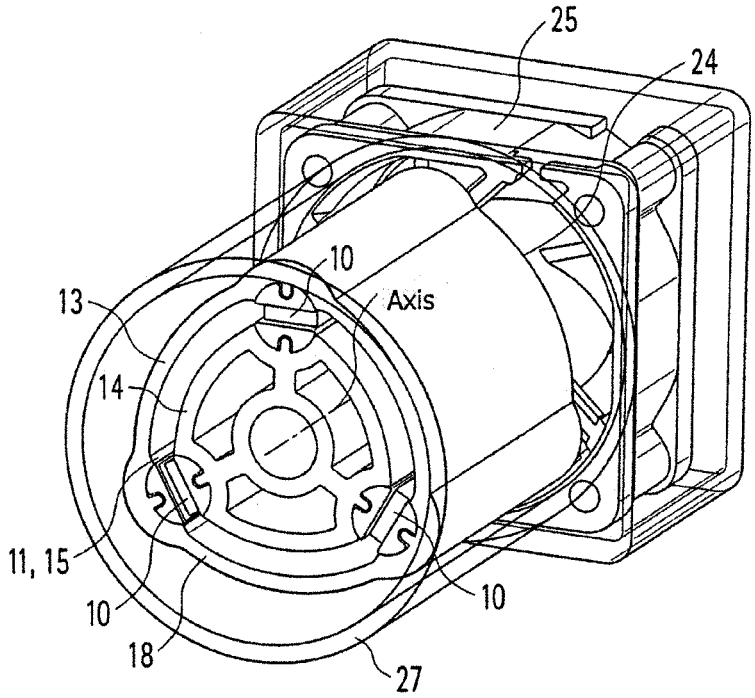
Figure 11:
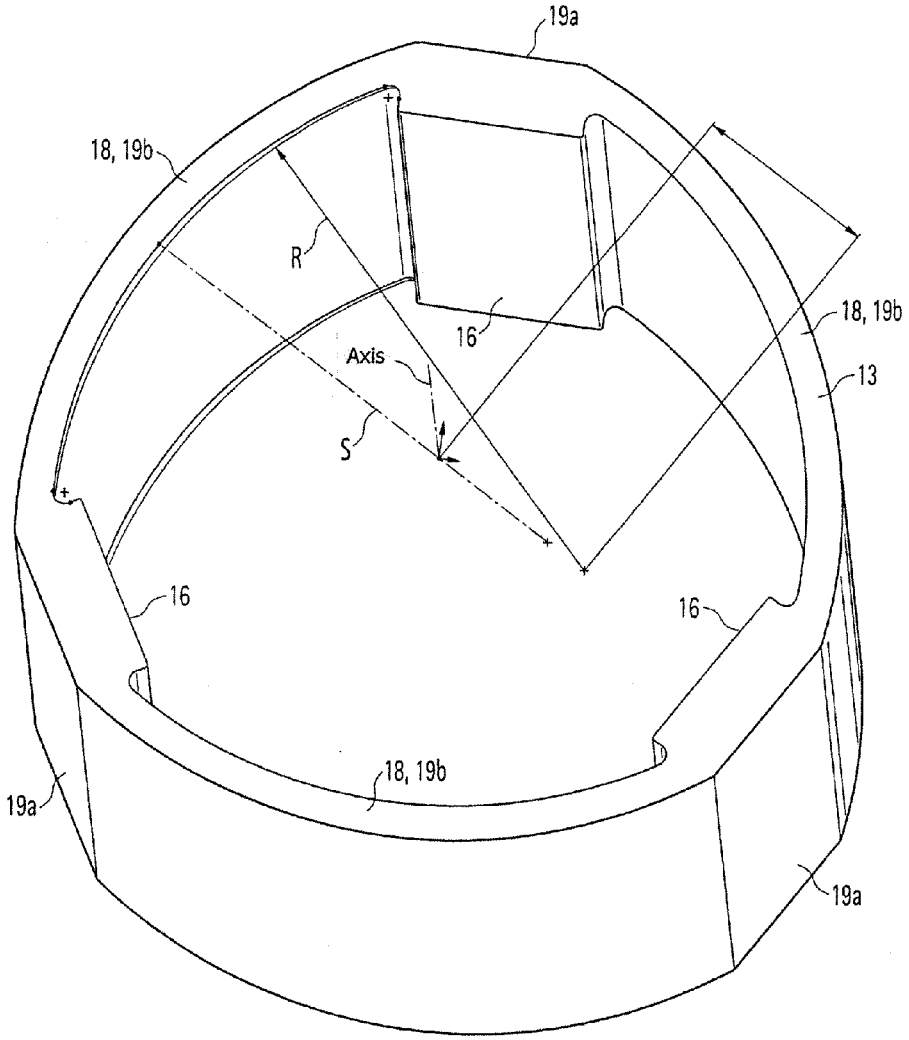
Figure 12:
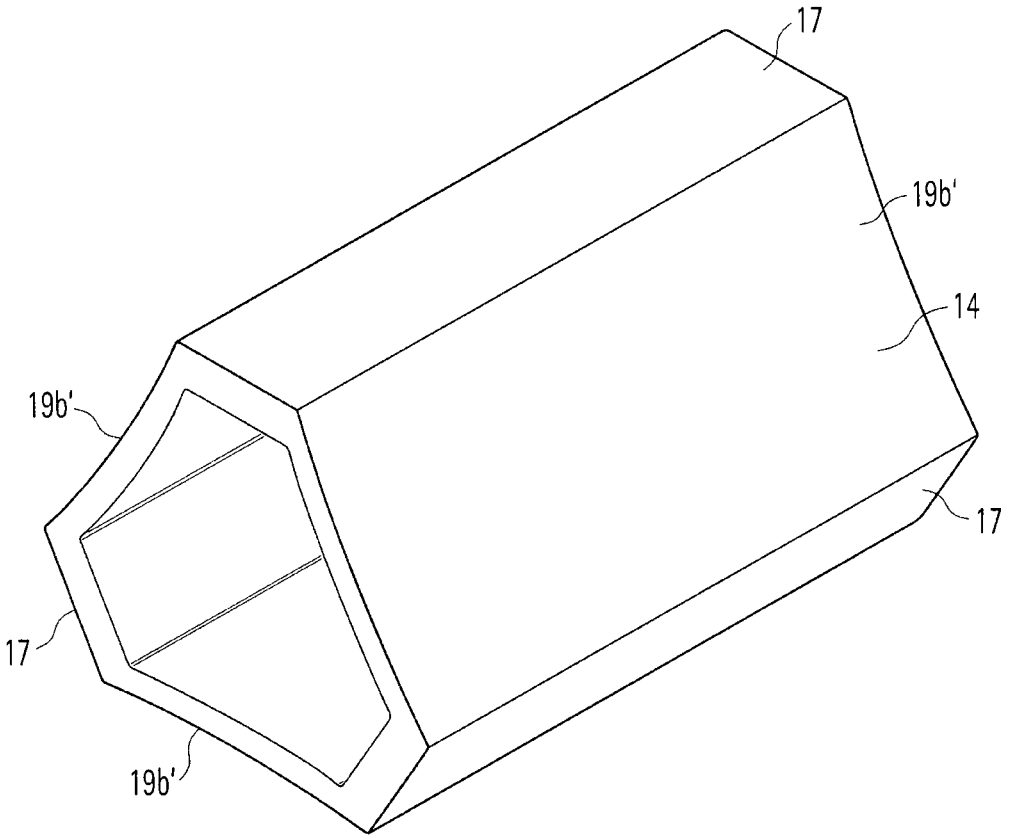
Figure 13:
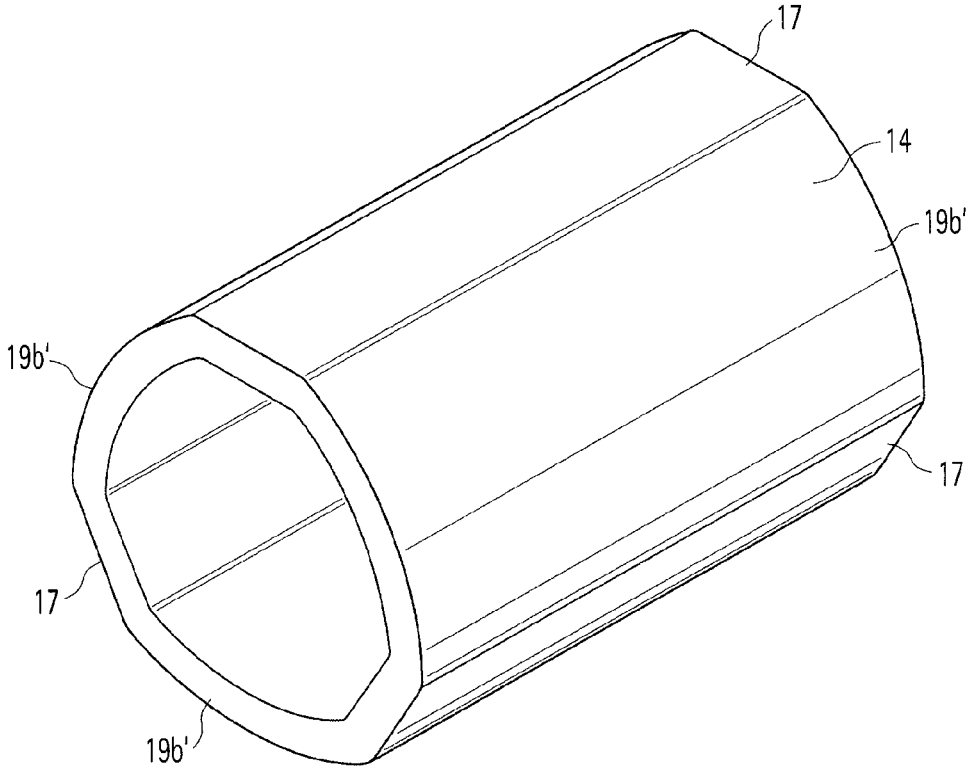

The invention is described in greater detail with further particulars based on embodiments with reference to the associated schematic Figures. These show:

FIG. 1 a perspective view of a cooling and holding body according to an embodiment according to the invention having a single peripheral layer of heating elements;

FIG. 2 a front view of the cooling and holding body according to FIG. 1;

FIG. 3 a perspective view of a cooling and holding body according to a further embodiment according to the invention having two peripheral layers of heating elements;

FIG. 4 a front view of the cooling and holding body according to FIG. 3;

FIG. 5 a perspective view of the cooling and heating body according to FIG. 3 whose axial end is joined to a fan and whose inner layer of heating elements has a mating aid;

FIG. 6: a perspective view of a cooling and heating body according to a further embodiment in which the heating elements are configured as PTC cartridges;

FIG. 7 a front view of the cooling and holding body according to FIG. 6;

FIG. 8 a perspective view of the cooling and holding body according to FIG. 6 having a mating aid;

FIG. 9 a partial section of the cooling and holding body according to FIG. 8;

FIG. 10 a perspective view of the cooling and holding body according to FIG. 6 which is surrounded by an insulating housing of a heater;

FIG. 11 a perspective view of the outer section of a cooling and heating body whose polygon sides have a wall thickness varying in the peripheral direction;

FIG. 12 a perspective view of an inner section having a concave polygonal profile;

FIG. 13 a perspective view of an inner section having a convex polygonal profile;

FIG. 1 shows a perspective view of a cooling and holding body for an electric heating element (10) according to an embodiment according to the invention which can be installed in a heater, as shown for example in FIG. 5 or 10. Within the scope of the invention, both the cooling and holding body per se with the heating elements, that is to say as an assembly, and also the whole heater having such a cooling and holding body is disclosed and claimed.

The heating elements are PTC heating elements known per se, that is to say thermistors with a positive temperature coefficient. Heating elements 10 generally have a flat rectangular block shape. Other heating elements are possible.

As illustrated in FIGS. 1 and 3, the cooling and holding body has an approximately cylindrical shape and extends in the axial direction, wherein the length of the cooling and holding body essentially corresponds to the length of PTC resistors 10*a* or heating elements 10 in general. The cooling and holding body protrudes somewhat beyond heating elements 10 on the end faces.

The cooling and holding body according to FIG. 1 has a ring-like outer section 13 which surrounds an inner section 14 like a shell. Outer section 13 forms a shell element. Inner section 14 and outer section 13 are arranged concentrically. Inner section 13 and outer section 14 are two separate components, wherein inner section 13 forms the core. Inner section 13 is not joined directly, that is not firmly bonded, to outer section 14 but only by means of heating elements 10 arranged between them. The core or inner section 13 is freely arranged within outer section 14.

Heating element holder 11 is configured between inner section 14 and outer section 13. A gap, in particular an annular-shaped gap, whose shape and/or width varies in the peripheral direction, is formed for this between inner section 13 and outer section 14. In the region of the gap between inner section 13 and outer section 14, a plurality of holding regions 15 are provided distributed around the periphery which together form a heating element holder 11. In the region of heating element holder 11 or relevant holding areas 15, the gap runs perpendicular to the radius of the cooling and holding body. Between holding regions 15, the gap follows the outline of clamping sections 16 or is limited by them radially on the outside. Holding regions 15 are therefore geometrically separated from clamping sections 16. However, this is not absolutely essential.

Heating elements 10 are arranged in holding regions 15. Heating elements 10 are thus located between inner section 13 and outer section 14 and are fixed in place there in a press-fit.

Holding regions 15 are arranged eccentrically on the periphery of the cooling and holding body and are spaced apart in the peripheral direction. In the example according to FIG. 1, the angle between two adjacent holding regions 15 is 120°. As a result, heating elements 10 are located in the ideal air flow.

For clamping heating elements 10, outer section 13 has clamping surfaces 16 and inner section 14 has corresponding holding surfaces 17 which oppose clamping surfaces 16. Clamping surfaces 16 configured on the inner periphery of holding section 13 and holding surfaces 17 configured on the outer periphery of inner section 14 form outer and inner contact surfaces 12 of relevant holding regions 15. Heating elements 10 lie against contact surfaces 12. Clamping and holding surfaces 16, 17 limit the gap or relevant holding regions 15 in the radial direction. Holding regions 15 are open in the peripheral direction. In the embodiment according to FIG. 1, clamping and holding surfaces 16, 17 are flattened or straight. This shape of clamping and holding surfaces 16, 17 is particularly well suited to direct joining to a flat PTC resistor 10*a*, as illustrated in FIG. 1. Other shapes are possible.

Clamping surfaces 16 immediately adjacent in the peripheral direction are joined by means of a convexly curved clamping section 18. Clamping section 18 can also be concavely curved or straight. In the assembled condition, clamping section 18 is elastically deformed and impinges heating elements 10 assigned to relevant clamping surfaces 16 with a contact force which acts in the manner of a spring in the direction of each assigned holding surface 17.

As can be seen in FIG. 1, outer section 13 has a polygonal profile, wherein clamping surfaces 16 are arranged in the region of corners 19*a* of the polygonal profile. Clamping sections 18 form sides 19*b* of the polygonal profile. Three sides are provided in the embodiment according to FIG. 3 which results in a statically defined construction. In the embodiment with a statically defined arrangement of the surfaces, the contact pressure is exerted concentrically on heating elements 10. The three-sided polygonal profile has the further advantage that the arrangement is self-centering which simplifies assembly. A different number of polygon corners is possible.

The polygonal profile of outer section 13 has the further advantage that sides 19*b* of the polygonal profile or clamping sections 18 can be impinged with an assembly force acting radially inwards, as illustrated in FIG. 2 by arrows M directed radially inwards. The assembly force can be applied, for example, by means of appropriately arranged assembly stamps (not illustrated). Clamping sections 18 are widened or lengthened somewhat by the assembly force such that clamping surfaces 16 migrate radially outwards as illustrated by smaller arrows L directed radially outwards in FIG. 2. A slight position change of clamping surfaces 16 is sufficient to enable assembly of the cooling and holding body. After the assembly of heating elements 10 between inner section 14 and outer section 13, the assembly force is released and the clamping effect of outer section 13 takes effect due to the elastic material deformation.

In the assembled condition, heating elements 10 are therefore fixed in a press-fit between inner section 14 and outer section 13, specifically between relevant holding surface 17 of inner section 14 and associated clamping surface 16 of outer section 13. At the same time, the interference between relevant heating element 10 and outer section 13 is adjusted such that the polygon sides or clamping sections 18 deform elastically. The deformation takes place within the range of Hooke's straight line, that is to say below the elastic limit. This applies to all holding regions 15. The person skilled in the art will carry out the adjustment of an appropriate interference depending on the relevant material properties.

Alternatively or additionally, assembly of the cooling and holding body may be thermally assisted in that outer section 13 is heated. After the assembly of heating elements 10 by means of thermal expansion, outer section 13 is cooled and shrinks onto them. Mechanical and thermal widening of outer section 13 can be combined. Mechanical widening can be varied depending on the shape of clamping sections 18. With convex clamping sections 18 (not illustrated), for example, outer section 13 can be widened with assembly forces acting radially outwards.

The wall thickness of outer section 13 is increased in the region of clamping surfaces 17 for even heat dissipation. Specifically, the wall thickness in the region of clamping surfaces 17 is greater than the wall thickness in the region of clamping sections 18. Heat dissipation can be increased by means of additional cooling ribs on the outer periphery of outer section 13 (not illustrated).

Inner section 14, specifically holding surfaces 17, on which heating elements 10 are arranged, has the function of an abutment. Thus inner section 14 is configured such that it can absorb the holding forces transmitted by outer section 13. Outer section 13 is therefore more elastically deformable than inner section 14. The rigid form of inner section 14 is achieved by a plurality of bars 20 extending in the radial direction. One holding surface 17 is arranged on the radial outer end of each bar 20. In the region of holding surfaces 17, bars 20 are T-shaped wherein the upper side of the T-profile forms holding surface 17. Bars 20 each have a foot 21 which in the embodiment according to FIG. 2 is joined to an inner cylinder 22.

Inner cylinder 22 is arranged concentrically in relation to the cooling and holding body. Inner cylinder 22 in question is hollow. The inner cylinder can have a different cross-section that that illustrated in FIG. 2.

Inner section 14 has a polygonal profile which substantially corresponds in its shape to the polygonal profile of outer section 13 as shown, for example, in FIG. 1. Sides 19*b*' of the polygonal profile of inner section 14 join holding surfaces 17 provided in the region of corners 19*a*' of the polygonal profile. The stability of inner section 14 is improved as a result.

Hollow chambers are configured between bars 20 in order to transport heated air away from the heating element effectively and quickly. This can be additionally improved by a machined surface (eddy effects).

The invention is not restricted to the polygonal profiles illustrated in FIGS. 1, 2 but also includes other geometries of outer section 13 or inner section 14. In general, polygon sides 19*b* or clamping sections 18 are curved, specifically curved convexly outwards or curved concavely inwards, between corners 19*a*. Polygon sides 19*b* or clamping sections 18 can be straight. Polygon corners 19*a* are considered to be the regions in which adjacent polygon sides 19*b* are joined. Polygon corners 19*a* extend transversely to the longitudinal axis of the cooling and holding body and form lay-on or contact surfaces 12 for heating elements 10. Polygon corners 19*a* are flattened, in particular flattened on the inside.

The number of heating elements 10 may vary. It is possible to use more than three heating elements 10, for example, in conjunction with a 4, 5 or multiangular polygonal profile of outer section 13. Holding regions 15 of a multiangular polygonal profile are distributed evenly around the periphery. In the embodiment example according to FIG. 1 with three heating elements 10, holding regions 15 or heating elements 10 are distributed around the periphery at an angle of 120°.

Aluminum or aluminum alloys can be used, for example, as the material for both outer section 13 and also inner section 14. Other materials are possible. The choice of material takes into account that after assembly an elastic deformation of clamping sections 18 occurs in such a manner that they exert a spring force on heating element 10 via clamping surfaces 16 in the direction of holding surfaces 17. The material alloys of inner section 14 and outer section 13 may be different so that different thermal expansions take place at the same temperature. The thermal coefficient of expansion of inner section 14 should be greater than the thermal coefficient of expansion of outer section 13.

FIGS. 3 and 4 illustrate a further development of the embodiment example according to FIGS. 1, 2 in which a plurality of heating element layers are provided. Specifically, in the embodiment example according to FIGS. 3, 4 two layers of heating elements are provided. Otherwise the embodiment examples according to FIGS. 1, 2 and FIGS. 3, 4 correspond to each other. In this respect, reference is made in connection with the embodiment example according to FIGS. 3 and 4 to the statements above regarding FIGS. 1, 2. The embodiment example according to FIG. 3 differs from the embodiment example according to FIG. 1 by intermediate section 23 which is arranged between inner section 14 and outer section 13. The shape of intermediate section 23 corresponds essentially to the shape of outer section 13. Accordingly, intermediate section 23 has a polygonal profile, wherein in the region of the polygonal profile's corners the wall is flattened both on the outer and also on the inner diameter. Moreover, the wall thickness in the region of the polygon corners is greater than in the region of the polygon sides. The transition from polygon side or chord and polygon corner has a radius such that the notch effect in the transition region is minimized or reduced. This also applies to the embodiment according to FIG. 1.

In the assembled condition, holding region 15 for heating element 10 is located on one side between inner section 14 and intermediate section 23. These holding regions 15 form the holding regions of heating element holder 11 arranged radially on the inside. Holding regions 15 configured between intermediate section 23 and outer section 13 form the radially outer holding regions. As illustrated in FIG. 3, the inner and outer holding regions are each located one on top of another in the radial direction.

Clamping sections 18 are provided between holding regions 15, wherein in the assembled condition clamping sections 18 of intermediate section 23 and clamping sections 18 of outer section 13 are arranged one on top of another. The position of the various sections or regions of intermediate section 23 and outer section 13 is thus arranged accordingly.

Inner section 14 of the embodiment example according to FIG. 3 corresponds essentially to inner section 14 of the embodiment example according to FIG. 1, at least in respect of the arrangement of radial bars 20.

The two-layer arrangement according to FIG. 3 can be extended to a three-layer, four-layer or generally multi-layer arrangement, wherein the number of intermediate sections 23 is adjusted accordingly. The shape of intermediate sections 23 corresponds in each case to the shape and position of outer section 13.

Mating means 26 which hold heating elements 10 in the correct position during assembly can be used for fitting the heating elements. As illustrated in FIG. 5, mating means 26 are configured as clamps which engage around bars 20 in the axial direction. As a result, the clamps are fixed on the inner periphery of inner section 14 at least in the peripheral direction.

In the embodiment examples according to FIG. 1, 2 or 3, 4, PTC resistors 10*a* are joined directly to inner section 14 or outer section 13. Deviating from this, FIG. 6 illustrates that PTC cartridges 10*b*, which are arranged at appropriate positions in the region of corners 19 of the polygonal profile, can be used with the cooling and holding body. The shape of holding surfaces 17 or clamping surfaces 16 is adapted to the outer contour of approximately cylindrical PTC cartridges 10*b* as also illustrated in FIG. 7. Holding surfaces 17 or clamping surfaces 16 are configured as half-shells. The half-shells are profiled and engage in an appropriate mating profile of the PTC cartridges, similarly to a tongue and groove system.

FIGS. 8, 9 illustrate that mating aid 26 can engage on outer section 13 unlike in the embodiment example according to FIG. 5.

FIG. 10 illustrates the cooling and holding body in the installed condition, wherein axial end 24 of the cooling and holding body is joined to a fan 25. The cooling and holding body is located in a housing 27 which can be insulated, for example, if the current-carrying PTC resistors are joined directly to outer section 13 and inner section 14 as illustrated in the embodiment example according to FIG. 1. The end face of housing 27 can be sealed with a protective grille which is not illustrated.

FIG. 11 illustrates a variation of outer section 13 in which the wall thickness or the thickness of polygon sides 19*b* changes in the peripheral direction of outer section 13. Specifically, the wall thickness decreases towards the edge regions of polygon sides 19*b*, i.e. towards corners 19*a*. Polygon sides 19*b* taper towards corners 19*a*. The maximum wall thickness is in the central region, specifically in the region of the apex of polygon side 19*b*. The apex is indicated by dash-and-dot line S which intersects the center point of outer section 13 and bisects polygon side 19*b*. As can be seen in FIG. 11, the change in wall thickness takes place continuously. The radius of polygon side 19*b* between the apex and corner 19*a* is denoted by R. Bracing of polygon side 19*b* which improves the transmission of force into the edge regions is achieved due to the increase in the wall thickness in the region of the apex of polygon side 19*b*. Other bracings of polygon side 19*b* are possible, for example bracing ribs, which prevent or reduce local deformation of polygon side 19*b* in the region of the apex or at the point where the assembly force is applied.

It is clear that the increase in the wall thickness in the region of the apex of polygon side 19*b* extends along the entire axial length of the outer section region.

FIGS. 12 and 13 illustrate embodiment examples in which inner section 14, that is to say the inner heating element core, is designed to be movable. The outer periphery of the heating element core or of inner section 14 can be made smaller by means of an appropriate application of force. This ensures that the gap between inner section 14 according to FIGS. 12, 13 and outer section 13 according to one of the previously mentioned embodiment examples is enlarged. Due to the larger gap, there is even better compensation of tolerances of the heating element to be introduced into holding region 15. Accordingly, the features described below of the inner sections according to FIGS. 12, 13 are disclosed and claimed in conjunction with all the embodiment examples previously mentioned.

The increased flexibility of inner section 14 according to FIGS. 12, 13 is achieved in that holding surfaces 17 are only supported radially inwards by sides 19*b*' of the polygonal profile. In other words, the differences in respect of the embodiment example according to FIG. 1 is that no bars are provided which support holding surfaces 17 radially inwards and thus stiffen inner section 14. Inner section 14 according to FIGS. 12, 13 is configured without internals, i.e. no supporting elements for holding surfaces 17 are provided in the interior of inner section 14. Holding surfaces 17 can therefore move radially inwards or radially outwards depending on the material properties and the assembly force to be applied.

This is achieved in that inner section 14 according to FIGS. 12, 13 is configured as a polygonal profile, wherein the examples according to FIGS. 12, 13 differ in the shape of polygon sides 19*b*'. In the example according to FIG. 12, polygon sides 19*b*' are concave, that is to say curved inwards. If a press force or assembly force acting inwards is applied to polygon sides 19*b*', holding surfaces 17 are pulled radially inwards and inner section 14 reduces in size. In the embodiment example according to FIG. 13, polygon sides 19*b*' are convex. Polygon sides 19*b*' curve outwards. If a spreading force or an assembly force which acts on polygon sides 19*b*' from the inside outwards is applied in the case of inner section 14 according to FIG. 13, the flat sides or holding surfaces 17 are also pulled radially inwards which results in the assembly gap increasing in size.

It is also conceivable to configure polygon sides 19*b*' to be straight.

In summary, outer section 13 forms a mechanical clamping element in the shape of a polygonal profile, wherein the contact force is achieved by means of an elastic deformation of outer section 13. In the stress/strain diagram, the deformation is thus brought about within the range of Hooke's straight line. The advantage of this is that additional spring elements can be dispensed with. The clamping effect is reinforced by the geometry of outer section 13 which has clamping sections 18 between clamping surfaces 16, in particular concavely curved or straight clamping sections 18. Clamping sections 18 bridge the distance between clamping surfaces 16 and join them together. The same principle can be realized by the inner section which is also configured as a polygonal profile.

Optimum heat extraction is brought about due to the overall low mass of outer section 13 combined with the strong clamping pressure which outer section 13 exerts on heating elements 10. This is assisted in that the heating elements are arranged on the outer periphery of the cooling and holding body. For a direct power supply, a channel may be configured in the material of the cooling and holding body in order to directly crimp on a phase or a neutral conductor.

LIST OF REFERENCE NUMBERS

10 Heating element
11 Heating element holder
12 Contact surfaces
13 Outer section
14 Inner section
15 Holding regions
16 Clamping surfaces
17 Holding surfaces
18 Clamping sections
19 Corners of polygonal profile 19*a*, 19*a*'/sides of polygonal profile 19*b*, 19*b'*
20 Bars
21 Foot
22 Inner cylinder
23 Intermediate section
24 Axial end
25 Fan
26 Mating means
27 Housing
R Radius
S Apex line

The invention claimed is:

1. A heater, comprising:

a cooling and holding body and heating elements, wherein the cooling body and holding body comprises a heating element holder in which the heating elements are clamped, wherein the heating element holder has a plurality of holding regions distributed in a peripheral direction, in each of which holding regions at least one heating element is clamped, wherein the holding regions are formed between an outer section having a wall thickness, and an inner section arranged in the outer section, and at least the outer section has a polygonal profile with a plurality of corners which are joined by sides having a thickness, wherein the holding regions are arranged in the corners of the polygonal profile and the sides of the polygonal profile are elastically deformed to generate a clamping force which acts on the respective heating elements.

2. The heater of claim 1, wherein the heating elements are PTC heating elements.

3. The heater of claim 1, wherein the corners of the polygonal profile form clamping surfaces which are adapted to the exterior shape of the heating elements.

4. The heater of claim 3, wherein the clamping surfaces are flattened.

5. The heater of claim 1, wherein the wall thickness of the outer section is greater in a region of the corners of the polygonal profile than in a region of the sides of the polygonal profile.

6. The heater of claim 1, wherein the sides of the polygonal profile are configured to be concave, convex or straight.

7. The heater of claim 1, wherein the thickness of the sides of the polygonal profile varies in the peripheral direction.

8. The heater of claim 7, wherein the thickness of the sides of the polygonal profile decreases in a direction towards the corners of the polygonal profile.

9. The heater of claim 1, wherein the inner section has a number of holding surfaces for the heating elements corresponding to the number of corners of the polygonal profile.

10. The heater of claim 9, wherein the inner section has a polygonal profile with a plurality of inner section corners which are joined by sides, wherein the holding surfaces comprise the inner section corners.

11. The heater of claim 9, wherein the holding surfaces are supported radially inwards only by the sides of the polygonal profile, or the holding surfaces are supported by bars extending inwards in a radial direction.

12. The heater of claim 1, wherein at least three heating elements are distributed in the heater in the peripheral direction.

13. The heater of claim 1, wherein a plurality of layers of heating elements arranged in a radial direction are provided, wherein a least one intermediate section is arranged between the outer section and the inner section, wherein the holding regions of the inner layer are configured between the inner section and the intermediate section and the holding regions of the outer layer are configured between the intermediate section and the outer section.

14. The heater of claim 1, wherein an axial end of the heating element holder is joined to a fan such that air can flow through the cooling and holding body in an axial direction.

15. A method for the manufacture of a heater of claim 1, comprising:

providing a heating element holder comprising a plurality of holding regions distributed in a peripheral direction, the holding regions formed between an outer section, and an inner section arranged within the outer section, and at least the outer section has an internal polygonal profile with a plurality of corners which are joined by sides, wherein the holding regions are located at the corners of the polygonal profile and the sides of the polygonal profile are elastically deformable;

enlarging the holding regions by heating or by applying an assembly force acting radially inwards or outwards to the sides of the polygonal profile, elastically deforming the polygonal profile;

inserting heating elements into the heating element holder holding regions while the polygonal profile remains elastically deformed; and cooling the heating element holder if elastic deformation has been achieved by heating, or removing the assembly force if elastic deformation has been achieved by an assembly force, in either case clamping the heating elements within the holding regions.

* * * * *